US008708040B2

(12) United States Patent
Wilson

(10) Patent No.: US 8,708,040 B2
(45) Date of Patent: Apr. 29, 2014

(54) DOUBLE STRING PUMP FOR HYDROCARBON WELLS

(75) Inventor: Dennis R. Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 12/895,019

(22) Filed: Sep. 30, 2010

(65) Prior Publication Data

US 2011/0073319 A1 Mar. 31, 2011

Related U.S. Application Data

(60) Provisional application No. 61/247,331, filed on Sep. 30, 2009.

(51) Int. Cl.
*E21B 43/12* (2006.01)
*F04B 35/01* (2006.01)

(52) U.S. Cl.
USPC ..... 166/109; 166/68; 417/547

(58) Field of Classification Search
USPC ..... 166/105, 107, 372, 109, 68; 417/547, 417/555.2
See application file for complete search history.

(56) References Cited

U.S. PATENT DOCUMENTS

| | | | | |
|---|---|---|---|---|
| 4,013,387 | A * | 3/1977 | Gage | 417/554 |
| 4,089,626 | A * | 5/1978 | Hill et al. | 417/431 |
| 4,207,036 | A * | 6/1980 | Secrist | 417/431 |
| 4,787,455 | A * | 11/1988 | Snavely et al. | 166/279 |
| 5,031,402 | A * | 7/1991 | Klaeger | 60/369 |
| 5,083,613 | A * | 1/1992 | Gregoli et al. | 166/275 |
| 5,382,142 | A * | 1/1995 | Spears | 417/445 |
| 6,142,224 | A * | 11/2000 | Stuebinger et al. | 166/105.5 |
| 6,186,238 | B1 * | 2/2001 | Tornquist | 166/369 |
| 6,263,965 | B1 * | 7/2001 | Schmidt et al. | 166/272.3 |
| 6,371,206 | B1 * | 4/2002 | Mills | 166/311 |
| 6,457,522 | B1 * | 10/2002 | Bangash et al. | 166/267 |
| 6,543,542 | B2 * | 4/2003 | Tieben | 166/369 |
| 6,543,543 | B2 * | 4/2003 | Muth | 166/370 |
| 7,108,059 | B1 * | 9/2006 | Lanier | 166/105 |
| 7,117,947 | B2 * | 10/2006 | Wilson | 166/372 |
| 7,541,315 | B2 * | 6/2009 | Jennings | 507/90 |
| 7,588,730 | B2 | 9/2009 | Buechler et al. | |
| 2003/0037929 | A1 * | 2/2003 | Leniek, Sr. | 166/369 |
| 2006/0002808 | A1 * | 1/2006 | Williams | 417/555.1 |

(Continued)

FOREIGN PATENT DOCUMENTS

WO 2009105501 8/2009

OTHER PUBLICATIONS

PCT "Notification of Transmittal of the International Search Report and the Written Opinion of the International Searching Authority, or the Declaration", Nov. 29, 2010, 17 pages.

*Primary Examiner* — William P Neuder
*Assistant Examiner* — Wei Wang
(74) *Attorney, Agent, or Firm* — ConocoPhillips Company

(57) ABSTRACT

A double string pump transports liquids to the surface of a hydrocarbon well including a hydrocarbon well that is producing both natural gas and liquid fluids. The double string pump includes a hollow tube that raises and lowers the plunger and carries the liquids to the surface and an outer tube receives liquids down into the well to lubricate the moving parts and flush particles from areas prone to wear and back toward the production tube. The natural gas is produced through the annulus between wellbore casing and the outer production tubing string.

18 Claims, 5 Drawing Sheets

(56) References Cited

U.S. PATENT DOCUMENTS

| | | | | |
|---|---|---|---|---|
| 2006/0011345 | A1* | 1/2006 | Delaloye et al. | 166/304 |
| 2006/0169458 | A1* | 8/2006 | Jones, Jr. | 166/369 |
| 2006/0278398 | A1* | 12/2006 | Ruggeri et al. | 166/369 |
| 2007/0158062 | A1* | 7/2007 | Heller et al. | 166/69 |
| 2007/0253848 | A1* | 11/2007 | Lea, Jr. | 417/437 |
| 2008/0002954 | A1* | 1/2008 | Carr, Sr. | 392/478 |
| 2008/0164034 | A1* | 7/2008 | Uttley | 166/372 |
| 2008/0190622 | A1* | 8/2008 | Johnson et al. | 166/372 |
| 2009/0196779 | A1* | 8/2009 | Weaver et al. | 417/552 |
| 2011/0073317 | A1* | 3/2011 | Wilson | 166/369 |
| 2011/0073318 | A1* | 3/2011 | Wilson | 166/372 |

* cited by examiner

DOUBLE STRING PUMP FOR HYDROCARBON WELLS

CROSS-REFERENCE TO RELATED APPLICATIONS

This application is a non-provisional application which claims benefit under 35 USC §119(e) to U.S. Provisional Application Ser. No. 61/247,331 filed Sep. 30, 2009, entitled "Double String Pump for Hydrocarbon Wells," which is incorporated herein in its entirety.

STATEMENT REGARDING FEDERALLY SPONSORED RESEARCH OR DEVELOPMENT

None.

FIELD OF THE INVENTION

This invention relates to down hole rod pumps that are typically used to pump liquids from the bottom of a hydrocarbon wells.

BACKGROUND OF THE INVENTION

As one travels through Texas and Oklahoma and other oil producing regions, it is common to see oil wells with rocking beam pumps in action. The beam is rocked like a seesaw by a motor while one end the beam lifts and lowers a sucker rod string to drive the down hole pump. The sucker rod string is typically made up of a number of twenty-five foot to thirty foot steel rod sections connected end to end to form a long string of rods that extend down into the production tubing of a well. The production tubing itself was inserted into the wellbore after the wellbore was drilled and cased. The production tubing is fixed in the wellbore with a down hole rod pump positioned near the bottom. As the sucker rod moves up and down in the production tubing, the pump draws liquids from the wellbore into a chamber of the pump through a first check valve during a first stroke and then pushes the liquids in the chamber through a second check valve during the return stroke. The liquids pass through the second check valve and into the production tubing above the pump so that the liquids are eventually pumped to the surface and are either piped or trucked to market.

Natural gas wells and many low rate oil wells are sometimes provided with pumps to periodically withdraw liquids that enter the wellbore from the formation and tend to accumulate and slow and eventually stop the production of hydrocarbons the natural gas. The liquid may be water, but may also include hydrocarbon liquids which are sufficiently valuable to collect and transport to market.

One of the problems associated with pump systems for small volumes of liquids in wells is that any solids, particularly small particles, that are produced tend to collect and cause trouble for the pump. If the liquid volume were substantially higher, the particles would likely be carried to the surface and not collect at the bottom of the production tubing. With low liquid production rates and intermittent pumping, the particles tend to collect in the production tubing on top of the pump and have been known to damage the pumps and pumping systems well short of their expected service life. This can be especially challenging in coal seam gas production wells where the particles tend to be very fine and abrasive and are susceptible of stacking out rod strings by caking up and packing between plungers and barrels and blocking the travel of check valves and other vital pumping equipment. Coal seam gas wells produce water and along with highly abrasive coal fines.

Many other wells produce sand which is a problem on a much larger scale in terms of total numbers of pumps exposed to particles. Some wells have sand delivered into the formation to hold open the fissures, fractures and perforations to enhance production of gas and liquids. This kind of sand is called proppant. Unfortunately such proppant sand causes many rod pump failures every year as some amounts exit the formation and creates hazard for moving equipment such as the pump in the wellbore. Another type of sand that is even more difficult for pumps to handle is formation sand, often referred to as flour sand. Formation sand is quite fine in nature and very difficult to control due to its fine size and mobility. It is highly abrasive and will wear out the polished surfaces of a pump or bury and stack out the pump.

SUMMARY OF THE INVENTION

The invention more particularly includes a system for producing liquids and solids from the bottom of a natural gas well including a string of production conduit installed in a wellbore where a lower end thereof is near the bottom of the wellbore. The system further includes a pump comprising a barrel and a plunger wherein the barrel is connected to the production conduit near its lower end and a string of hollow rod string is disposed within said production conduit such that a tubing annulus is formed around the hollow rod string where the hollow rod string is connected to the plunger that is positioned within the barrel of the pump for movement up and down the barrel. The system further includes a column of filtered liquid within the tubing annulus on top of the barrel and plunger.

In a further aspect of the system, check valves are provided within the hollow rod string to prevent particles that might settle in liquid from descending below the check valves and maintaining the particles at a level in the wellbore closer to the surface so that when the pump is operating, the particles are pushed closer and closer to the surface to eventually be fully removed from the well.

The invention may further be viewed as a process for producing liquids and solids from the bottom of a natural gas well where an open ended string of production conduit is installed in a wellbore with a seating nipple near the open lower end of the production conduit and a pump is installed at the end of a string of hollow rod string where the pump includes a barrel and a hollow plunger and where the hollow plunger is connected to and in fluid communication with the hollow rod string and further includes a traveling valve to admit liquids into the hollow interior of the plunger and wherein the barrel includes a standing valve to admit liquids from below the seating nipple into the barrel. A barrel is connected to the seating nipple and seal the interior of the production tubing from the open lower end of the production tubing wherein a tubing annulus is defined within the production tubing above the seating nipple and outside the hollow rod string. Substantially particle free liquid is provided into the tubing annulus to be in contact with the barrel and the outside of the plunger and as the plunger is raised and lowered, it draws liquids through the standing valve and through the traveling valve and eventually into the hollow rod string.

In a preferred arrangement, a portion of the liquids are produced through the hollow rod string are directed through a filter and then back into the tubing annulus.

In another preferred arrangement, gas is produced through gas production annulus and a quiet zone is defined below the seating nipple above the open end of the production tubing and gas that enters the quiet zone is allowed to exit back into the gas production annulus from an upper portion of the quiet zone.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Turning now to the preferred arrangement for the present invention, reference is made to the drawings to enable a more clear understanding of the invention. However, it is to be understood that the inventive features and concept may be manifested in other arrangements and that the scope of the invention is not limited to the embodiments described or illustrated. The scope of the invention is intended only to be limited by the scope of the claims that follow.

Figure 1:
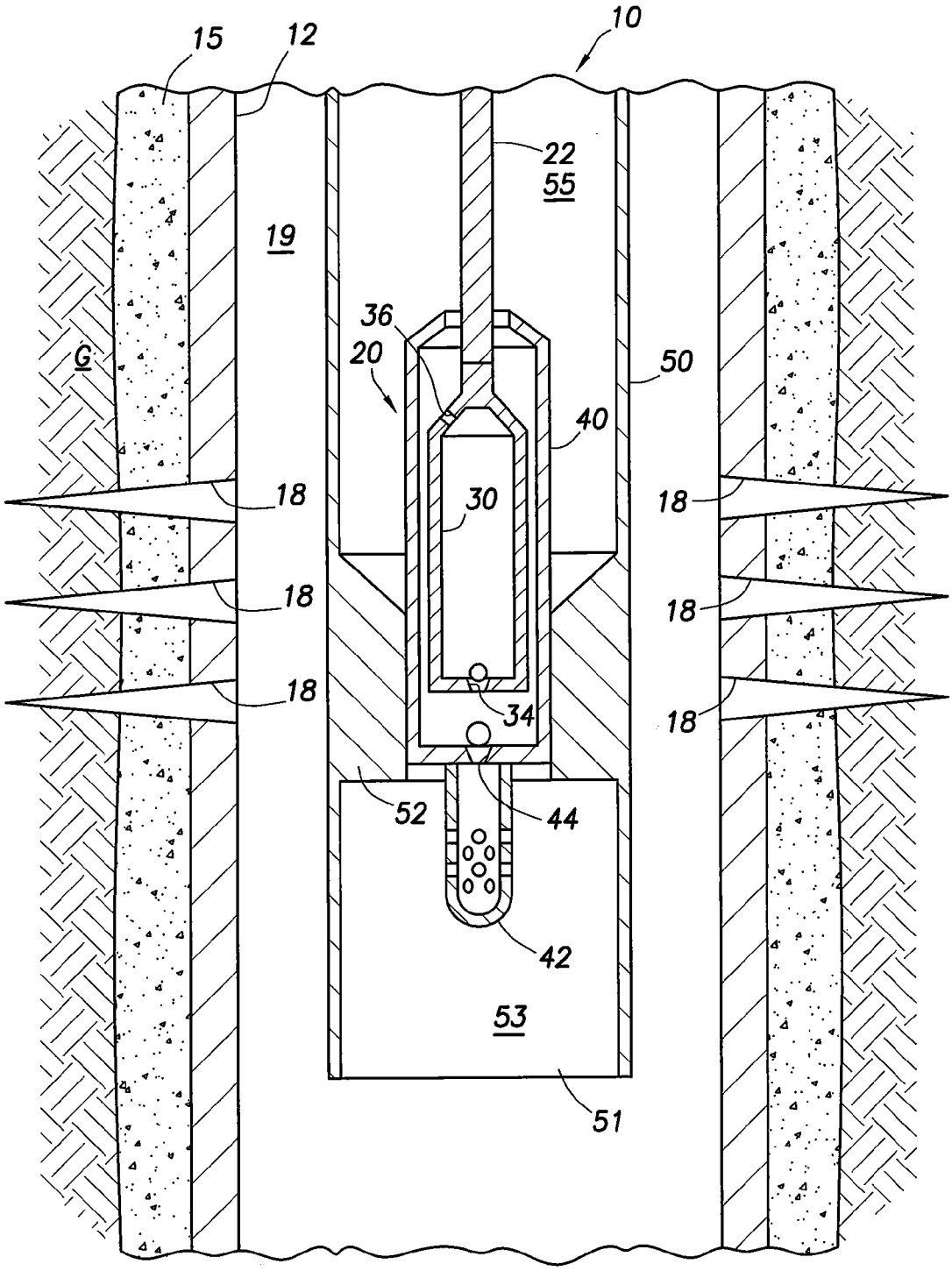
FIG. 1 (PRIOR ART)
FIG. 1 is a cross section of a prior art version of a pumping system for pumping liquids to the surface of a natural gas well.

In FIG. 1, a wellbore, generally indicated by the arrow 10, is shown formed or drilled into the ground G. According to conventional procedures, casing 12 has been inserted into the wellbore and sealed against the wall of the wellbore with cement 15 whereafter perforations 18 have been punched through the casing 12 and through the cement 15 and into a hydrocarbon-bearing formation in the ground G by explosive charges. Hydrocarbons in the hydrocarbon-bearing formation are then enabled to flow into the wellbore 10 through perforations 18 where natural gas and other gases would ascend up the wellbore through annulus 19 while liquids accumulate at the bottom of the wellbore 10.

In natural gas wells, liquids that are also produced from the formation tend to slow or block the production of the natural gas into the wellbore 10 so it is generally more productive to maintain the level of liquids below the lowest of the perforations 18. The liquid level is drawn down by a production system including a pump, generally indicated by the arrow 20 that is associated with production tubing 50. The pump 20 and production tubing 50 are run into wellbore 10 separately with the production tubing 50 being first inserted into the wellbore 10. The production tubing 50 is sufficiently smaller than the casing 12 so that gas is easily able to flow up to the surface through annulus 19. The production tubing 50 also has an open bottom end 51 preferably below the lowest of the perforations 18 and above the bottom of the wellbore 10. Production tubing further includes a segment 52, generally called a seating nipple, that includes an inside contour and dimension to receive barrel 30 and seal the barrel in place. Seating nipples typically have a shoulder stop or a reduction of the interior dimension also referred to as "ID", and a highly machined surface or polished bore for packing seals on barrel 30 to engage into. Thus, the barrel 30 is installed after the production tubing 50, but may be sealed in seating nipple 52 and therefore sealed and isolating the interior 55 of the production tubing 50 from the annulus 19 of casing 12. The production tubing 50 is therefore divided into a small segment at the bottom, called a quiet zone 53 and a production path 55 above the seating nipple 52.

The pump 20 includes a plunger 30 arranged to move up and down within the barrel 40. The plunger 30 is attached to the bottom end of a hollow rod string 22 and is able to move up and down within the barrel 40 that is firmly connected or locked into the seating nipple 52, but it should be understood that the periphery of the plunger 30 and the interior of the barrel 40 are each machined and sized so that any liquid flow around the plunger 30 is substantially restricted. The preferred path for liquids to travel through the barrel 40 is also through the interior of the plunger 30. Below the barrel 40 is a strainer nipple 42 having a number of holes to allow liquids or gas that is in the quiet zone 53 to pass into the barrel through stranding valve 44. Standing valve 44 is shown to be a ball and seat, but may be any suitable one-way valve technology. As the plunger 30 is lifted relative to the barrel 40, liquids are drawn up through the strainer nipple 42 and through standing valve 44 to fill the space in the barrel 40 below the plunger 30. The plunger 30 includes a travelling valve 34, that like the standing valve 44, is shown as a ball and seat, but may be any suitable one-way valve technology. As the plunger 30 is lowered in the barrel 40, standing valve 44 closes to keep liquid in the barrel but unseat the travelling valve so that the liquids in the barrel below the plunger 30 enter and flow into the plunger 30. Liquids that were already in the plunger 30 before the plunger began its downward movement in the barrel exit the top of the plunger 30 through one or more vent holes 36. Liquids that pass out of the vent holes 36 fill the production path 55 and are eventually delivered to the surface.

In operation, pump 20 operates intermittently to lift liquids out of the bottom of the wellbore 10 so that hydrocarbon production is optimized. A number of operation schemes can be employed, but typically, the pump 20 is started based on elapsed time from the most recent pump operation cycle and continues until a reduced weight of the plunger 30 is detected, meaning that the liquids at the bottom of the well are reduced and that the pump 20 has had a gas break through. One of the problems with this arrangement that has been identified by the inventor is that particles such as sand and grit are going to pass into the and through the pump 20, but tend to settle back down in the production path 55 during times of inactivity. In some wells, it is common for just a barrel, or two or three barrels to be pumped off the bottom to maintain natural gas production, but these few barrels may not make it to the surface for days or weeks. By the time a certain volume of liquid makes it to the surface, the small entrained solids are quite likely to have settled and even when stirred up, never make it to the surface. These solids collect around the top of the pump 20 and are prone to cause premature failure of the pump by getting into the top of the gap between the outside of the plunger 30 and the inside of barrel 40. Wear on these highly machined surfaces will likely to cause a pump failure.

Another problem that comes up with the arrangement shown in FIG. 1 is called gas lock and it occurs when gas is drawn through the strainer nipple and fills the space in barrel 40 below the plunger 30. The gas in this tight space can be insufficient to unseat the travelling valve 34 with the weight of the liquid column above the travelling valve 34 in production path 55 pressing down. The contained volume of gas gets repeatedly compressed and decompressed by movement of the plunger 30 in the barrel 40, but no liquids are conveyed to the surface through the production path 55. While the pump is unable to reduce the liquid level from the bottom of the wellbore, liquids that are continually produced from the formation eventually choke off the natural gas production through 19. As the gas flow slows, the liquid flow may diminish and the productivity of the well will eventually be permanently impaired. If particles get into the same space described with the gas lock, the incompressible solids eventually prevent the plunger 30 from reaching the bottom of its travel and reduce the capacity of the pump or cause distortion of the path of the plunger 30 such that the pump eventually fails.

Figure 2:
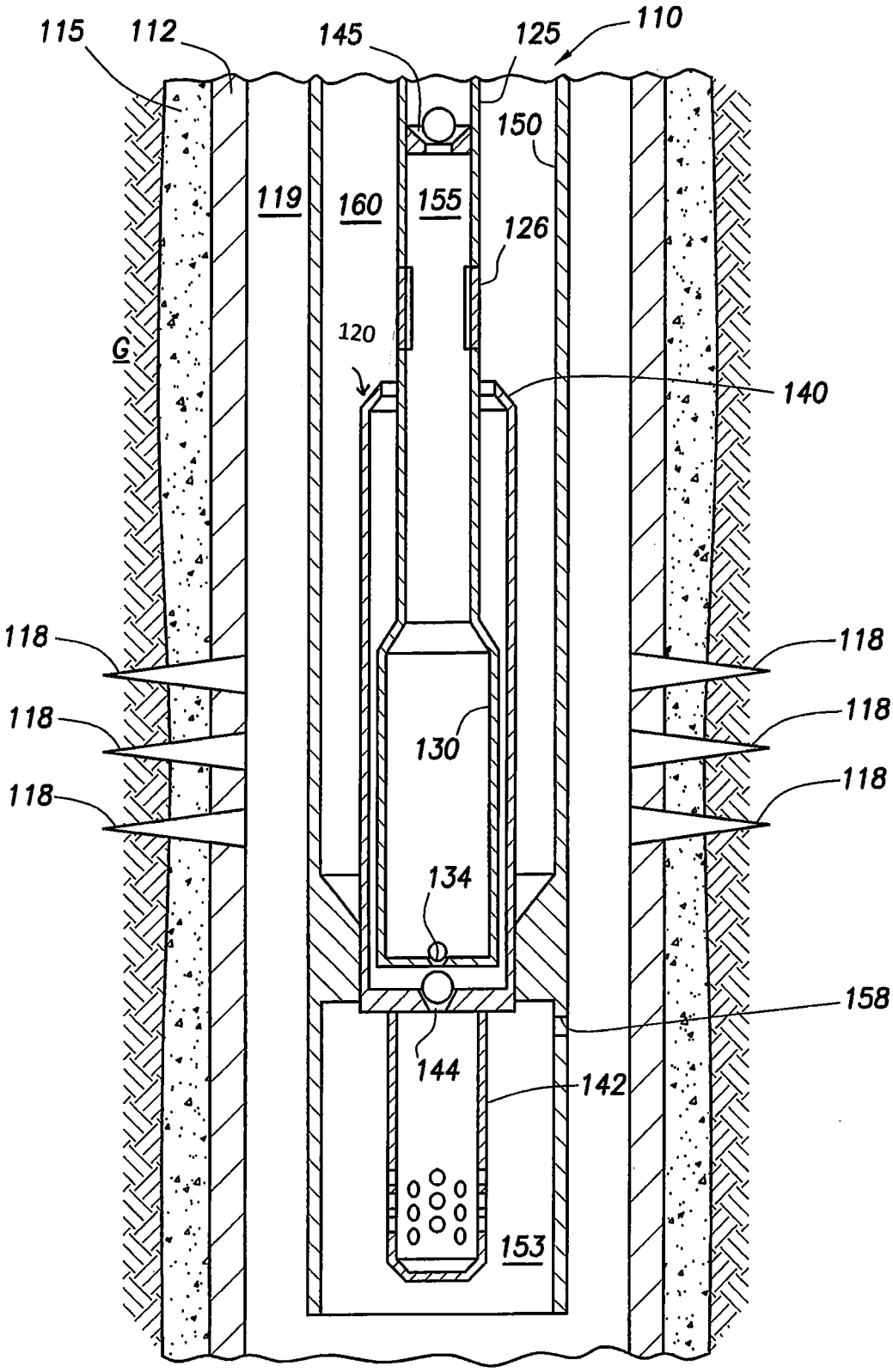
FIG. 2 is a cross section of a first embodiment of an inventive pumping system shown in a well for pumping liquids to the surface of a natural gas well.

To alleviate these and other problems identified in the embodiment of FIG. 1, a pumping system is shown in FIG. 2 where similar elements are identified with similar numbers except being three digit numbers with the first digit being "1". For example, casing 112 in FIG. 2 is essentially the same element as casing 12 in FIG. 1.

Focusing on the differences between the invention and the embodiment in FIG. 1 is a plunger 130 is moved up and down inside the barrel 140 by a hollow rod string 125. The hollow rod valve 125 is similar to sucker rod 22, but has additional functions and features. The plunger 130 is arranged to convey the liquid up the hollow rod string 125 where the inner diameter of the hollow rod string 22 is much smaller than the production path 55 in FIG. 1. Thus, each stroke of the plunger 130 may move the same volume of liquid, but the liquid moves far closer to the surface at a higher velocity so that the entrained solids are more likely to be carried farther up the production path 155 within the hollow rod string 125 during each pump operation cycle. Moreover, check valves, such as shown at 145, are provided within the production path 155 so that when a pumping cycle is ended and the pump 20 is idled, the particles only settle down to the last check valve each particle may have passed. Ideally, the check valves or ball checks 145 are spaced within the string so that the volume between them does not exceed the volume expected to be pumped during each a pumping cycle so that particles pass through at least one check valve during each pump cycle. Also, with the smaller diameter in the production path 155, the pump rate should equal or exceed the lift velocity required for the well and re-entrainment of the solids into the liquid flow should be quicker and more certain.

Figure 5:
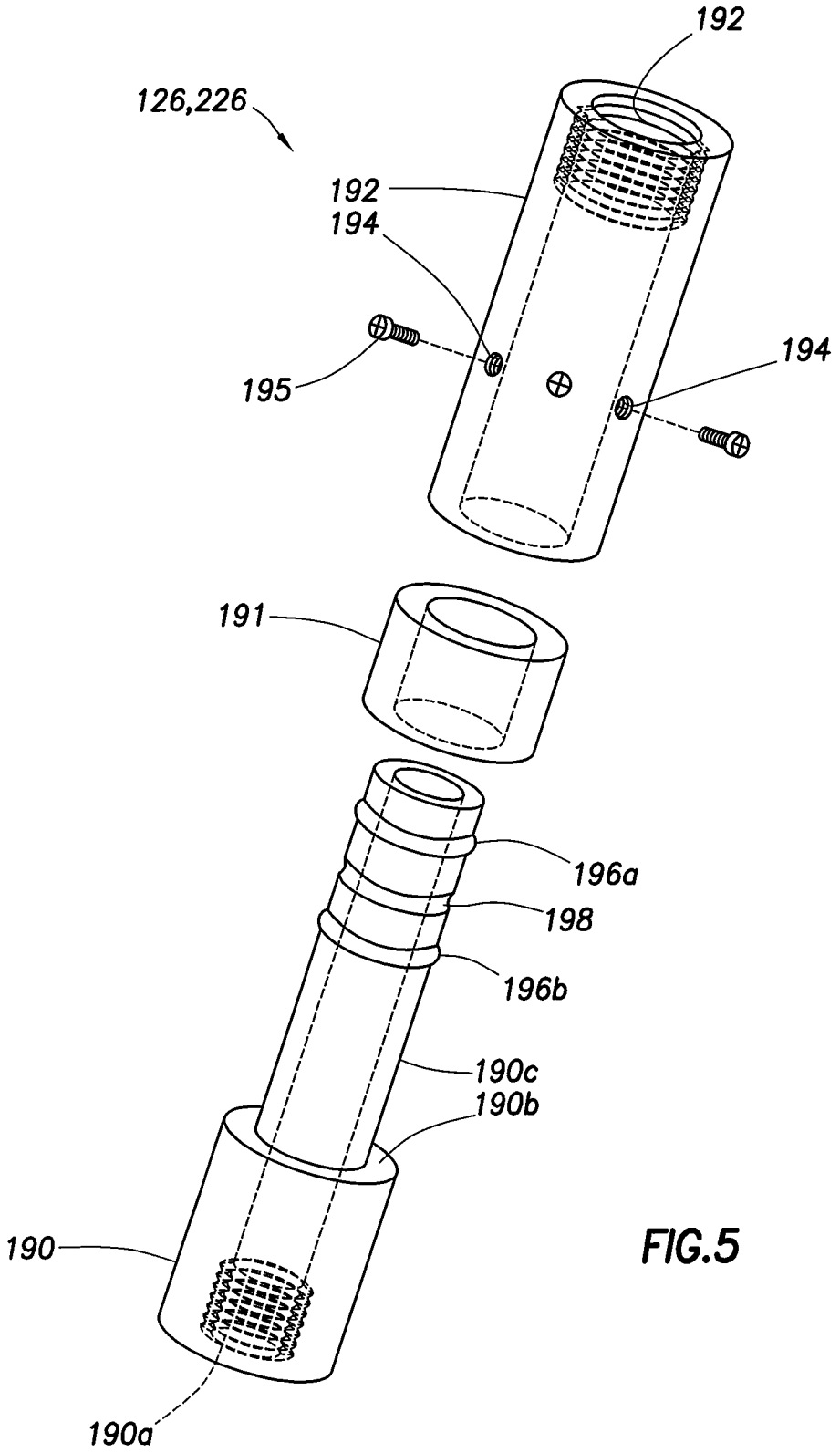
FIG. 5 is an exploded perspective view of a hollow shear tool for providing preferred breakaway for the production systems of the present invention.

In one aspect of the invention, hollow rod string 125 is connected to plunger 130 by a hollow shear tool 126. The hollow shear tool 126, which will be more fully explained in relation to FIG. 5, provides a well operator with a predetermined "weakest link" for the production system in the event that the pump 120 is stuck in the wellbore 110. In that circumstance, the well operator will know that lifting on the hollow rod string 125 with a tension above the shear strength of the hollow shear tool 126 will cause the hollow shear tool to separate near the pump 120. The remaining portion of the hollow shear tool 126 is suitable for wireline or other high strength fishing tools to get the pump 120 out of the wellbore. If fishing is not effective, the production tubing may be withdrawn without the complication of also disconnecting the segments of hollow rod string that are inside the segments of production tubing. An operator of a wellbore will prefer a system that is predictable in its failure mode and fails in a manner that minimizes delays to returning to operation.

A second aspect of the embodiment in FIG. 2 is that there is now a tubing annulus 160 that is inside the production tubing 150, and outside the rod string 125. This tubing annulus 160 is filled with production liquid that has been carried to the surface and filtered. Thus, the plunger 130 has clean liquid around the outside thereof and to the extent that any filtered liquid might pass along the small gap around the outside of the plunger 130 and within the barrel 140, it would tend to sweep any particles in that gap back into a location where such particles are directed up into production path 155. Ideally, the level of filtered liquid would extend to the surface so that the pressure head on either side of the plunger is the same or very close to the same. At the end of the pump operation cycle, it is preferred that the plunger 130 is in the "up" position so that if gas had entered the space below the bottom of plunger 130 and above standing valve 144 that some amount of filtered liquid in the barrel 140 would pass through the small gap during the idle time and occupy enough space to unseat the traveling valve 134 before the plunger reaches it full bottom stroke. As long as the travelling valve 134 can be unseated, the gas will quickly pass into the plunger and the gas lock condition will be alleviated without having to undertake substantial intervention. In an alternative embodiment, double standing and double travelling valves may be preferred where fluid travels through a first of the double valves and then through the second. A double valve arrangement provides redundancy in the event that solid particles block open one of the valves.

While abrasion and wear are the primary concern of the inventor, another aspect of the present invention that may help avoid gas locks is to provide a vent 158 to allow any gas that has entered the quiet zone 53 such as gases dissolved from the hydrocarbon liquid to pass back into the annulus 119 and exit the well 10. The vent 158 is above the highest opening in the strainer nipple 42 so that the liquid level inside the quiet zone 153 is not lower than the liquid level outside the quiet zone in the annulus 119. Another strategy to alleviate gas lock is to increase the fluid slippage past the plunger/barrel interface from annulus 160 into barrel 140 to displace traveling valve 134 and push gas into flow path 155.

Figure 3:
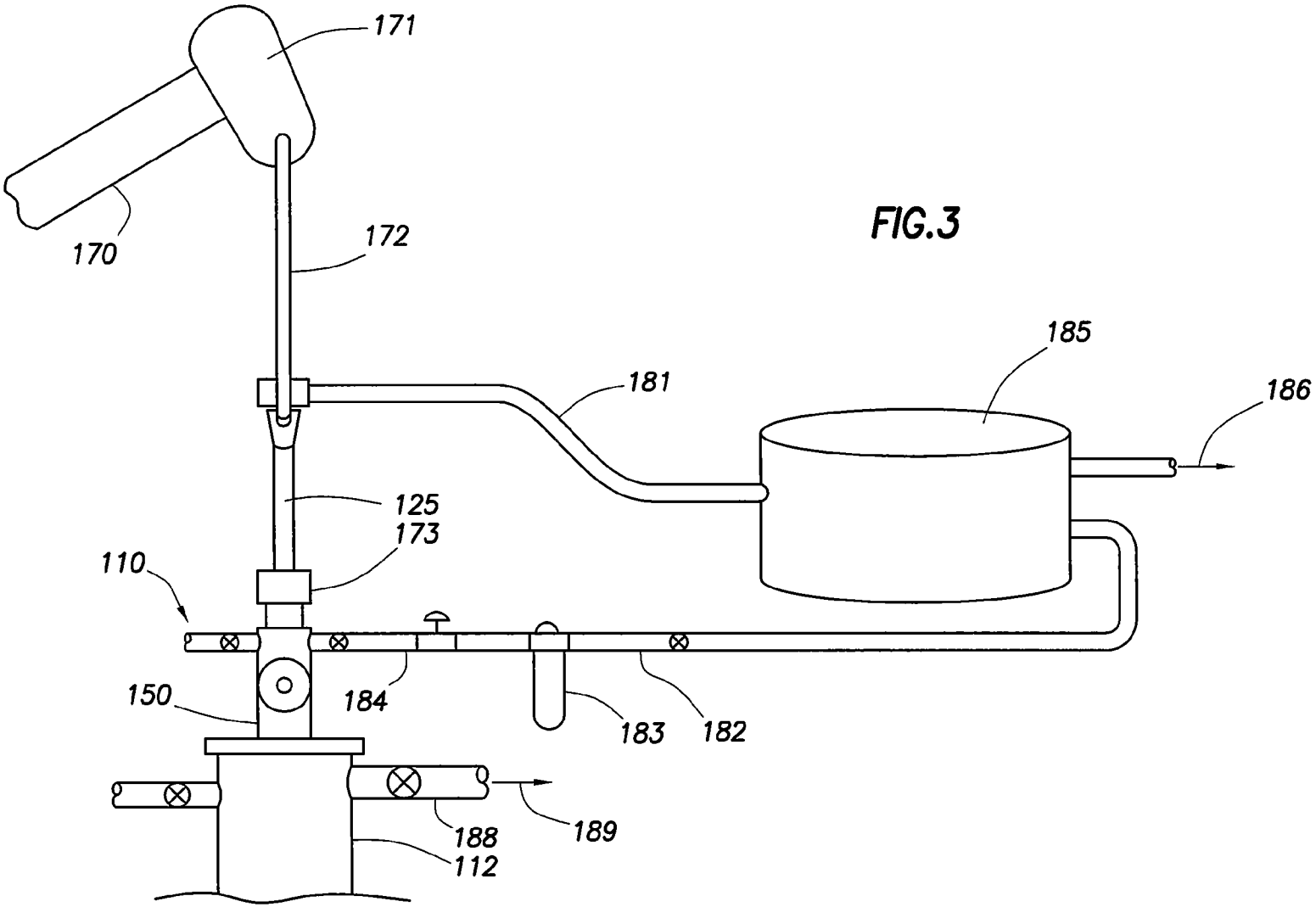
FIG. 3 is a fragmentary perspective view of the surface of the well showing the arrangement for providing filtered liquid back to the bottom of the production tubing.

Turning now to FIG. 3, a horse-head shaped bracket 171 is positioned at the end of a rocking beam 170 with a linkage 172 connected to the upper end of hollow rod string 125. As the rocking beam 170 lifts and lowers the bracket 171, the hollow rod string 125 raises and lowers through packing 173. Packing 173 seals tubing string against the hollow rod string 125 as the hollow rod string telescopes in and out of the wellbore 110. A swivel at the top of the hollow rod string connects to a flexible hose 181 to carry liquids produced from the hollow rod string 125 to storage, such as storage tank 185 or to market as indicated by the arrow 186. Some amount of the liquid is carried back into the wellbore 110 through conduit 182. Preferably, such liquids will allow solids to settle in the storage tank and to be sure that the recirculated liquids are "clean", are also filtered by any acceptable filtering technology such as a cartridge filter 183. The clean liquids are then directed through conduit 184 into piping that leads to the inside of production tubing 150. Natural gas that has passed up the annulus 119 to the top of the well is directed into gas gathering line 188 to be conveyed to market as indicated by arrow 189. Before leaving the description of FIG. 3, it should be seen and understood how simply the tubing annulus 160 may be maintained with a column of particle free liquids. At times, it may be advantageous to provide additional liquids into the tubing annulus 160 such as chemicals for inhibiting corrosion or scale or dealing with other issues. The tubing annulus 160 may also provide access for injecting hot oil or hot water to alleviate wax buildup or carry lubricants for the pump and other moving equipment downhole. The inventors also see an opportunity to provide clean water down tubing annulus 160 to slurry debris around the pump 120.

In another aspect of the invention, the tubing annulus 160 provides other options for dealing with challenges in wellbores. For example, in the event the a well produces a lot of sand, a perforated pipe section may be installed just above the seating nipple to allow clean liquids to descend into the wellbore 112 without interfering with the gas production. Once the clean liquids are past or below the perforations 118, the perforated section allows the liquids to entrain the sand or solids and provide sufficient liquids to operate the pump 120 continuously. While a full column of clean liquid would no longer be practical once the production tubing 150 is pierced, the primary concern of sand collection would have been addressed. However solids free liquid would either be maintained on top of the pump or would continuously pass by the pump depending on the location of the liquid exit port(s).

The production tubing 150, may also be provided with an opening to the annulus 119 to provide a path to direct a chemical treatment such as a scale, corrosion or paraffin inhibitor to a location that is prone to such problems anywhere up or down the length of the wellbore. It should be noted that even hot liquid such as water or oil to enhance production. The tubing annulus 160 provides many new options for addressing a near endless list of challenges in the oil field.

In one further preferred aspect related to FIG. 3, a rod rotator may be installed at the top of the well near the location where the bracket 171 attaches to the hollow rod string 125 to rotate the hollow rod string 125 and spread any wear from the up and down motion evenly around the outside of the sucker 125 for longer rod string life. Also, with the rod string 125 being hollow, it will likely and preferably have a larger diameter than equivalent non-hollow rod string of the same strength and will therefore have a larger radius distributing any load on the inside of the production tubing 150 in a manner that will reduce wear on the production tubing 150.

While it should be understood that the invention introduces two tubing strings which enables operators of wells to control the operating environment of the pump 120. The invention provides a way to flush water or other liquid to the pump from above (through the inside of the production tubing 150) or from below the pump through the annulus 119. In one particular advantage, the seating nipple or short section of pipe may be slotted or ported to provide a path for injection of liquids or chemicals or both into the wellbore anywhere up or down the production tubing 150. In cold weather circumstances, the string may be warmed with heated liquids injected into production tubing 150 that would thaw any ice that may have formed during a cold night or extended cold period. Some formations produce paraffins that may precipitate into waxy solids when exposed to temperatures below the formation temperature. Solvents may be added to the liquids in the production tubing 150 in the tubing annulus 160 that dissolves the waxy solids. Paraffin control may be accomplished by a combination of heated liquids and solvents.

It should further be understood that while the adjacent surfaces of the outside of the plunger 130 and inside of barrel 140 are preferably machined with close tolerances to prevent liquids from passing through the gap, some amount of liquids will pass through the gap. In fact, with the arrangement of the tubing annulus 160 providing clean liquids and liquids with additives for paraffin control, lubrication of the pump 120, control of scale, and other preventive measures, it may be preferable to open the tolerances of the barrel and plunger. This small amount of flow can be described as liquid slippage and opening up the tolerances slightly would increase the pump slippage. Such added pump slippage reduces the potential for gas lock and provides a direct route to lubricate the pump and any places along the production tubing where the hollow rod string comes into contact with the production tubing.

Figure 4:
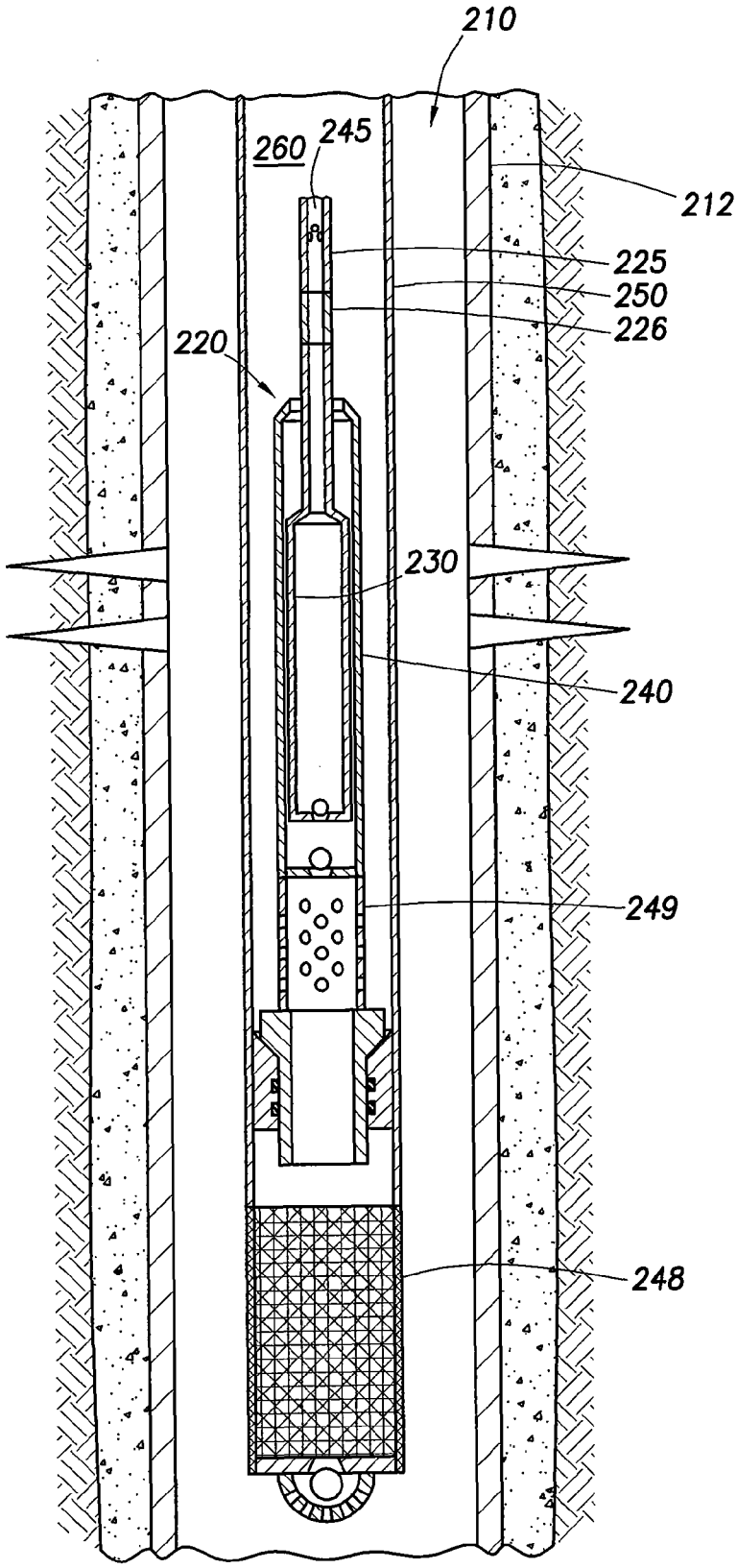
FIG. 4 is a is a cross section of a second embodiment of an inventive pumping system shown in a well for pumping liquids to the surface of a natural gas well.

Turning now to a second embodiment of the present invention shown in FIG. 4, similar features are numbered similarly to FIG. 2 with the first number being "2" rather than "1". In FIG. 4, the tubing annulus 260 is generally kept dry except to periodically flush the pump with clean liquid. Production liquids are allowed into the production tubing 250 through screen 248 and flow upward inside production tubing 250 through perforated sub 249 to surround the barrel 240. The pump 220 periodically pumps the liquids to the surface though the standing valve 244 and travelling valve 234 as described above. When concern arises that sand or other particulates may be accumulating around the pump 220 or collecting around filter 248, clean or particle free liquids may be flushed down the tubing annulus 260 to provide more liquid to pump and entrain the sand and also to back flush the filter 248. A purge check 262 or one way valve is provided at the bottom of the production string to allow the flushing liquid out of the bottom thereof. The purge check 262 is arranged to allow flow out of the bottom of the production tubing 250, but not permit flow there through into the production tubing 250. Again, the advantage of this arrangement is that liquid production is carried up the hollow rod string 225 and a tubing annulus is available to provide access to the pump to perform preventive maintenance on the pump 220.

Turning now to FIG. 5, the hollow shear tool 126/226 will be explained. The hollow shear tool 126/226 comprises three segments. Base segment 190 includes screw threads **190*a* to attach to the plunger 130/230 with ring segment 191 overlying the upper, smaller diameter portion 190*c* of base segment 190. The ring segment slides down smaller diameter portion 190*c* until it contacts shoulder 190*b*. Breakaway segment 192 also slides over smaller the diameter portion 190*c* until holes 194 generally align with groove 198 in smaller diameter portion 190*c*. Breakaway segment 192, like base segment 190 includes screw threads that are arranged to attach to the hollow rod string 125/225. O-rings 196*a* and 196*b* are provided to seal the hollow interior passageway from the outside of hollow shear tool 126/226. With a preselected number of screws screwed into holes 194 and into groove 198, a predetermined breakaway strength can be provided so that when a tension between the hollow rod string 125/225 and plunger 130/230 exceeds the predetermined breakaway strength, the breakaway segment 192 will separate from the base portion. The predetermined breakaway strength may be easily tested using conventional machine shop tools such as a press and pressure gauge by removing ring segment 191 and inserting a number of screws 195 and applying compression force until the screws break. The three segments 190, 191 and 192 are sized so that when all three are assembled, compression force is translated through the hollow shear tool 126 by their respective ends pressing against the adjacent end. In other words, the bottom end of breakaway segment 192 would press against the corresponding flat end of the ring segment 191 and the bottom end of ring segment would press against the shoulder 190*b* of base segment 190. The screws 195 would not be expected to carry much, if any compression load in operation. However, with the ring segment 191 removed, the entire compression load between breakaway segment 192 and base segment 190 would, in contrast, actually be carried entirely by the screws 195. The screws 195**, in the arrangement of the hollow shear tool, should provide the same breakaway strength in compression and tension. The inventor expects that breakaway strengths of roughly 10,000 pounds or 15,000 pounds may be achieved and using stronger or weaker materials would expand the capacity range of such an arrangement. Clearly, the ease at which the breakaway strength may be successively measured should provide confidence in the actual breakaway strength. Unused screw holes are preferably blinded off to reduce the possibility of sand entering the hollow shear tool and potentially altering its performance.

One interesting aspect of this arrangement is that with the liquids coming to the surface within a hollow rod string, the liquids exit the well pumping system on the "downstroke" of the rod pump. In conventional rod pumps, the liquid production occurs on the "upstroke." This point may not seem significant, but it does reveal that the present invention is quite different than prior systems.

Finally, the scope of protection for this invention is not limited by the description set out above, but is only limited by the claims which follow. That scope of the invention is intended to include all equivalents of the subject matter of the claims. Each and every claim is incorporated into the specification as an embodiment of the present invention. Thus, the claims are part of the description and are a further description and are in addition to the preferred embodiments of the present invention. The discussion of any reference is not an admission that it is prior art to the present invention, especially any reference that may have a publication date after the priority date of this application.

The invention claimed is:

1. A system for producing liquids, solids and gas from the bottom of a hydrocarbon well where the system comprises:

a) a wellbore;

b) a string of production conduit installed in the well, wherein the string of production conduit includes an open end below a seating nipple, wherein the open end thereof is near the bottom of the well, wherein the open end includes a vent to allow gas that has entered the open end to exit, wherein the string of production conduit has an interior and an exterior and wherein a gas production annulus is defined within the well and around the exterior of the production conduit for natural gas to flow to the surface;

c) a pump disposed within the production conduit comprising a barrel and a hollow plunger, wherein the barrel is attached to the production conduit at the seating nipple; and d) a string of hollow rod disposed within said production conduit such that a tubing annulus is formed around the hollow rod string within the interior of the string of production conduit and where the hollow rod string is connected to the plunger via a hollow shear tool that is positioned within the barrel of the pump for movement up and down within the barrel wherein a liquid path to the surface is defined where liquid enters the barrel from the well, moves from the barrel into the plunger and then into the string of hollow rod and then to the surface; such that e) three distinct spaces are defined that extend from at least near the pump to the surface wherein a first space is the gas production annulus, a second space is the tubing annulus for containing a filtered liquid from the surface disposed inside the production conduit and in contact with the hollow rod and the barrel to the plunger and a third space is the liquid path inside the string of hollow rod where the inner diameter of the hollow rod string is smaller than the production conduit.

2. The system according to claim 1 further including check valves within the hollow rod string to prevent particles that might settle in liquid from descending past the check valves and maintaining the particles at a level in the wellbore closer to the surface so that when the pump is operating, the particles are pushed closer and closer to the surface to eventually be fully removed from the well.

3. The system according to claim 1 further including a filter system at the surface for producing a filtered liquid and directing the filtered liquid into the tubing annulus on top of the barrel and plunger.

4. The system according to claim 1 further including a column of filtered liquid in the tubing annulus that, by gravity resists the flow of any liquid from inside the barrel around the plunger and into tubing annulus and thereby reduce the probability of surface wear on the outside of the plunger and inside of the barrel caused by solids in the production fluids.

5. The system according to claim 1 further including an additive injection system for adding chemical into the tubing annulus for maintenance of the hydrocarbon production equipment.

6. The system according to claim 5 wherein the additive injection system injects scale inhibitor.

7. The system according to claim 5 wherein the additive injection system injects corrosion inhibitor.

8. The system according to claim 1 wherein the wellbore includes casing having an interior and wherein the gas production annulus is formed between the interior of the casing and the exterior of the production conduit.

9. A process for producing liquids and solids from the bottom of a natural gas well wherein the process comprises:

a) installing a string of production conduit with an open bottom end into the well with a seating nipple above the open bottom end of the string of production conduit wherein the string of production conduit has an interior and an exterior wherein a gas production annulus is defined to be within the well but around the exterior of the production conduit and gas is produced to the surface through the gas production annulus, wherein the open bottom end includes a vent to allow gas that has entered the open bottom end to exit;

b) installing a pump hollow rod string into the string of production conduit, wherein the pump includes a barrel and a hollow plunger, wherein the hollow plunger is connected to the end of the hollow rod string, wherein the interior of the hollow rod string defines a production path, wherein the production path includes check or ball valves, wherein the valves are spaced within the hollow rod string so that the volume between the valves does not exceed the volume pumped during a pumping cycle, wherein the hollow plunger is connected to the hollow rod string by a hollow shear tool and the hollow plunger is in fluid communication with the hollow rod string so that liquids may pass from the hollow plunger through the hollow rod string and up to the surface, wherein the hollow plunger further includes a traveling valve to admit liquids into the interior of the hollow plunger, wherein the barrel includes a standing valve to admit liquids from below the seating nipple into the barrel;

c) connecting the barrel to the seating nipple and sealing the interior of the production conduit from the open bottom end of the production conduit wherein a tubing annulus is defined within the production conduit above the seating nipple and outside the hollow rod string;

d) providing substantially particle free liquid into the tubing annulus at the surface to pass down the tubing annulus and be in contact with the barrel and the outside of the hollow plunger; and e) raising and lowering the hollow plunger to draw liquids through the standing valve and through the traveling valve and directing the liquids into the hollow rod string and up to the surface where the inner diameter of the hollow rod string is smaller than a production path.

10. The process according to claim 9 wherein a portion of the liquids produced through the hollow rod string are directed through a filter and back into the tubing annulus.

11. The process according to claim 9 wherein a quiet zone is defined below the seating nipple and above the open end of the production tubing and gas that enters the quiet zone is allowed to exit back into the gas production annulus from an upper portion of the quiet zone.

12. The process according to claim 9 further including the step of adding chemical into the tubing annulus for accomplishing improved hydrocarbon production.

13. The process according to claim 12 wherein the step of adding a chemical comprises adding a scale inhibitor.

14. The process according to claim 12 wherein the step of adding a chemical comprises adding a corrosion inhibitor.

15. The process according to claim 12 wherein the step of adding a chemical comprises adding a paraffin dissolving agent.

16. The process according to claim 9 wherein the step of providing substantially particle free liquid into the tubing annulus further comprises providing the substantially particle free liquid as a back flush for the production conduit.

17. The process according to claim 9 further including the step of preventing solids from flowing and settling back down the hollow rod string on the pump by providing check valves along the length of the hollow rod string so that solids and fluid will advance from one check valve to at least the next check valve during successive pump cycles, even on low fluid volume wells.

18. The method according to claim 9 further including the step of providing casing within the well wherein the casing has an interior and wherein the gas production annulus is formed between the interior of the casing and the exterior of the production conduit.

* * * * *